US006675495B2

(12) United States Patent
Dedieu et al.

(10) Patent No.: US 6,675,495 B2
(45) Date of Patent: Jan. 13, 2004

(54) METHOD FOR DRYING SAW TIMBER AND DEVICE FOR IMPLEMENTING SAID METHOD

(75) Inventors: Bernard Dedieu, Olivet (FR); Abdelaâziz Bouirdéne, Balma (FR)

(73) Assignee: Valeurs Bois Industrie, Saran (FR)

( * ) Notice: Subject to any disclaimer, the term of this patent is extended or adjusted under 35 U.S.C. 154(b) by 0 days.

(21) Appl. No.: 10/215,183

(22) Filed: Aug. 9, 2002

(65) Prior Publication Data

US 2003/0037458 A1 Feb. 27, 2003

Related U.S. Application Data

(63) Continuation-in-part of application No. 09/530,326, filed on Jul. 6, 2000, now Pat. No. 6,473,994, and a continuation-in-part of application No. 09/959,570, filed on Oct. 30, 2001, now Pat. No. 6,581,299.

(30) Foreign Application Priority Data

| | | |
|---|---|---|
| Oct. 30, 1997 | (FR) | 97 13641 |
| Oct. 29, 1998 | (FR) | PCT/FR98/02318 |
| Apr. 30, 1999 | (FR) | 99 05555 |
| Apr. 28, 2000 | (FR) | PCT/FR00/01141 |

(51) Int. Cl.[7] ..... F26B 3/34

(52) U.S. Cl. ..... 34/245; 34/259; 34/263; 34/343; 34/198; 34/396; 34/77; 219/682; 219/690; 530/202; 528/503; 210/761; 210/748; 210/767; 422/186

(58) Field of Search ..... 34/245, 255, 257, 34/259, 263, 265, 343, 487, 493, 497, 197, 198, 216, 217, 218, 396, 518, 77, 92; 144/380; 219/682, 690, 695, 700, 756; 530/202; 528/503; 210/761, 748, 767; 422/186

(56) References Cited

U.S. PATENT DOCUMENTS

| | | | |
|---|---|---|---|
| 3,721,013 | A | 3/1973 | Miller |
| 3,845,270 | A | 10/1974 | Widugris, Jr. |
| 3,986,268 | A | 10/1976 | Koppelman |
| 4,343,095 | A | 8/1982 | Rosen et al. |
| 4,447,402 | A | 5/1984 | Cox |
| 4,469,156 | A | 9/1984 | Norimoto et al. |
| 4,488,361 | A | 12/1984 | Lööf |
| 4,862,599 | A | 9/1989 | Brunner |
| 4,893,415 | A | 1/1990 | Moldrup |
| 5,195,251 | A | 3/1993 | Gyurcsek et al. |
| 5,247,975 | A | 9/1993 | Tanahashi et al. |
| 5,343,913 | A | 9/1994 | Tanahashi et al. |

(List continued on next page.)

FOREIGN PATENT DOCUMENTS

| | | |
|---|---|---|
| DE | 517 714 C | 9/1929 |
| EP | 0 505 586 | 9/1992 |
| FR | 2013770 | 4/1970 |
| FR | 2064865 | 7/1971 |
| FR | 2 770 441 | 5/1999 |
| GB | 2 306 090 A | 4/1997 |
| WO | WO 82 01411 A | 4/1982 |
| WO | WO 82 01766 A | 5/1982 |
| WO | WO 93 02842 A | 2/1993 |

*Primary Examiner*—Henry Bennett
*Assistant Examiner*—Andrea M. Ragonese
(74) *Attorney, Agent, or Firm*—Nixon & Vanderhye P.C.

(57) ABSTRACT

The invention relates to a process for drying wood, characterized in that it comprises a pressurizing step to place a sealed chamber (1) under a predetermined pressure by injecting or generating saturating steam and maintaining this pressure for a predetermined time interval, while ensuring a forced circulation of air and saturating steam within the chamber, a heating step to heat the wood core and central zone of the wood pieces by emitting microwaves at frequencies ranging between 400 and 2450 MHz, an evacuation step to carry away the liquid exudates from the wood when run down to the bottom of the chamber (1) where they are collected.

45 Claims, 4 Drawing Sheets

U.S. PATENT DOCUMENTS 5,558,800 A 9/1996 Page
6,029,368 A * 2/2000 Banerjee et al. ..... 34/255
6,080,978 A * 6/2000 Blaker et al. ..... 219/775
6,105,278 A 8/2000 Gerrish et al.
6,317,997 B1 * 11/2001 Kooznetsoff et al. ..... 34/92
6,365,240 B1 * 4/2002 Banerjee et al. ..... 428/15
6,473,994 B1 * 11/2002 Dedieu et al. ..... 34/396

* cited by examiner

METHOD FOR DRYING SAW TIMBER AND DEVICE FOR IMPLEMENTING SAID METHOD

CROSS-REFERENCES TO RELATED APPLICATIONS

This application is a continuation-in-part of U.S. application Ser. No. 09/530,326, filed Jul. 6, 2000 now U.S. Pat. No. 6,473,994 and U.S. application Ser. No. 09/959,570, filed Oct. 30, 2001 now U.S. Pat. No. 6,581,299.

BRIEF SUMMARY OF THE INVENTION

The present invention relates to a process for drying sawmill timber and wood items.

The invention is particularly useful for the treatment of "sawmill timber". By the wording "sawmill timber" is meant timber directly derived from initial processing (sawing).

A process is known from patent application WO 82/01766 for drying timber which uses microwaves at a frequency of 915 MHz applied to wood to be dried in order to raise its inner temperature and cause it to discharge water. The discharged water is evaporated on the surface of the wood by a circulation of air at low speed obtained using fans. The air with a moisture content of approximately 80% passes over condensers to extract this moisture.

In document WO 82/01411, the same principle is used, but in this latter document it is specified in addition that the temperature of the air must always be lower than the inner temperature of the wood. This document points out the drawback of having to heat the surface area of the material with microwaves before heating the inner part of the material. In this document, it is therefore proposed to control the process of converting magnetic energy into heat energy so as to concentrate the waves on the water within the material. Also, it is suggested to act on the climate within the chamber by maintaining a sufficiently high percentage of air humidity to prevent the surface of the product from drying out before removal of the moisture from the core of the wood. For this purpose, during the initial phase of the drying process, water in atomized form is added to the chamber to maintain a high humidity level.

Similarly, the article published in the review "Holz als roh und werkstoff" in 1995, pages 333 to 338, Springer-Verlag Editions, entitled "Microwave drying of pine and spruce" by A. L. ANTTI describes drying wood with microwaves operating at frequencies of 915 or 2450 MHZ and a power density in the range of 25 to 78 kW/m$^3$ to raise the inner temperature of the wood to approximately 140° C. and achieve a steam pressure inside the wood of 25 KPa. The inner pressure achieved in this way is very high and enables swift evacuation of the water. The disadvantage of the process is that it develops breaks in fibers. The drying process starts by quick microwave drying in the region of 70° C. followed by intermittent exposure to microwaves during drying, and finally a drying operation under wood temperature control to remain below fiber saturation by limiting temperature to a maximum of 110° C.

In all configurations, it is evident that air is used as the vehicle to remove the moisture which exits from the wood. On this account, the air humidity level must remain below the saturation level of air in steam. It is therefore necessary in known systems to de-humidify the air in order to carry out wood drying. Also, it is necessary for the air temperature to be lower than the wood temperature to allow evaporation.

All these systems have the disadvantage of generating large energy losses and do not optimize energy consumption. The higher the required wood temperatures, the greater the proportional amount of microwave generating power is required, and since drying times last several hours energy consumption is high and therefore costly. It can be noted in the article cited above that drying times are between 3 and 5 hours depending upon wood thickness and the power of the equipment used. Also, none of these known processes manages to achieve less than 30% moisture content in the wood after drying.

The purpose of the present invention is to put forward a process with which it is possible to optimize energy and reduce the power of the microwave means while rapidly obtaining complete drying of the wood, from the green state to a final moisture content in the order of 10%, or even less depending upon operating conditions.

This purpose is achieved through the fact that the wood drying process comprises:

- a pressurizing step, to place at least one sealed chamber 1 under a determined pressure by injecting or creating saturating steam, and maintaining this pressure for a determined time interval while ensuring forced circulation of air and saturating steam within the chamber;
- a heating step, to heat the wood core and the central part of the wood items to be dried, by emitting microwaves at frequencies of between 400 and 2450 MHz;
- an evacuation step, to carry away the liquid exudates which exit the wood and run down to the bottom of the chamber 1 where they are collected.

According to another particularity, the liquid exudates are permanently evacuated.

According to another particularity, the exudates are intermittently evacuated.

According to another particularity, the evacuation step is followed by a gradual pressure-lowering step down to atmospheric pressure after stoppage of the microwaves.

According to another particularity, the evacuation step comprises physico-chemical treatment of the exudates to make them compatible with evacuation towards the waste water circuit.

According to a further particularity, the liquid exudate evacuation step is followed by a collection step in a container for the purpose of further chemical treatment.

According to another particularity, the pressure-lowering step is completed by a de-humidifying step of ambient air in the chamber by passage of the stream of air from the chamber onto a humidity absorption device and cooling of the air within the chamber.

According to another particularity, the applied microwave emitting powers are of decreasing magnitude from the core of the wood pieces towards the outside.

According to another particularity, the saturating steam pressure is in the range of 2 bars to 15 bars.

According to another particularity, the steam pressure is less than 10 bars to obtain a treated wood moisture content of more than 6%.

According to a further particularity, the steam pressure, at least during a determined drying time, is between 10 and 15 bars and the temperature produced will reach a value lying in the range of 200 to 220° C. to obtain a dry, naturally polymerized wood having a moisture content close to 0%.

According to another particularity, the power of the microwave generator is calculated so that the internal heat of the wood is higher than the temperature of the saturating steam.

A further purpose of the invention is a system enabling the implementation of the process.

This purpose is achieved through the fact that the system is made up of a pressure-resistant sealed chamber communicating via windows in quartz, or any other material suitable for microwaves, with a waveguide that is connected by impedance adapters to a microwave generator, said windows being arranged crosswise to the stack of wood, the chamber being connected to a pressurized air recirculation pathway which aspirates air from one side of the wood stack via grids and repels the air on the other side of the wood stack by means of diffusion grids, and pressurized steam generating means connected to the chamber.

According to another particularity, the system comprises a steam condenser circuit connected in parallel to the air recirculation circuit and in selective manner via valves.

According to another particularity, the system comprises in its lowest part an evacuation outlet operating under gravity to evacuate the exuded waters which is controlled by a valve.

According to another particularity, the system comprises:

one end which can be closed by an automatic door to ensure sealing against pressure and microwaves;

conveying means to transport the green wood loads to be dried, which means are electrically separated from the transport means located on the other side of the automatic airlock in relation to the chamber.

According to another particularity, the unit formed by the chamber and pre-loading zone is encased in a second protective chamber protecting against radiation leakage, this chamber being accessible from the outside via flexible doors.

According to another particularity, the microwave generator is embedded in the ground and communicates with the drying chamber via a waveguide.

According to another particularity, the chamber comprises a safety valve.

According to another particularity, the valve is opened intermittently.

According to another particularity, the valve is opened permanently.

According to a further particularity, the outlet is connected to a physico-chemical treatment system to render the exudates compatible with waste water evacuation standards.

A final purpose of the invention is to put forward a chemical component extraction method using the process and system of the invention consisting of:

treating one single type of green wood species by applying microwaves in an atmosphere of saturating steam under determined pressure and temperature conditions, collecting the liquid exudate produced by the single species treatment operation, optionally re-treating this exudate with physico-chemical methods to remove various chemical components that can be used in the cosmetic, perfume, agro-foodstuffs, pharmaceutical and chemical industries.

According to another particularity, the treatment of pine species leads to obtaining an exudate having insecticide properties.

Other particularities and advantages of the present invention will become clearer on reading the following description made with reference to the appended drawings in which:

DETAILED DESCRIPTION OF THE INVENTION

Figure 1A:
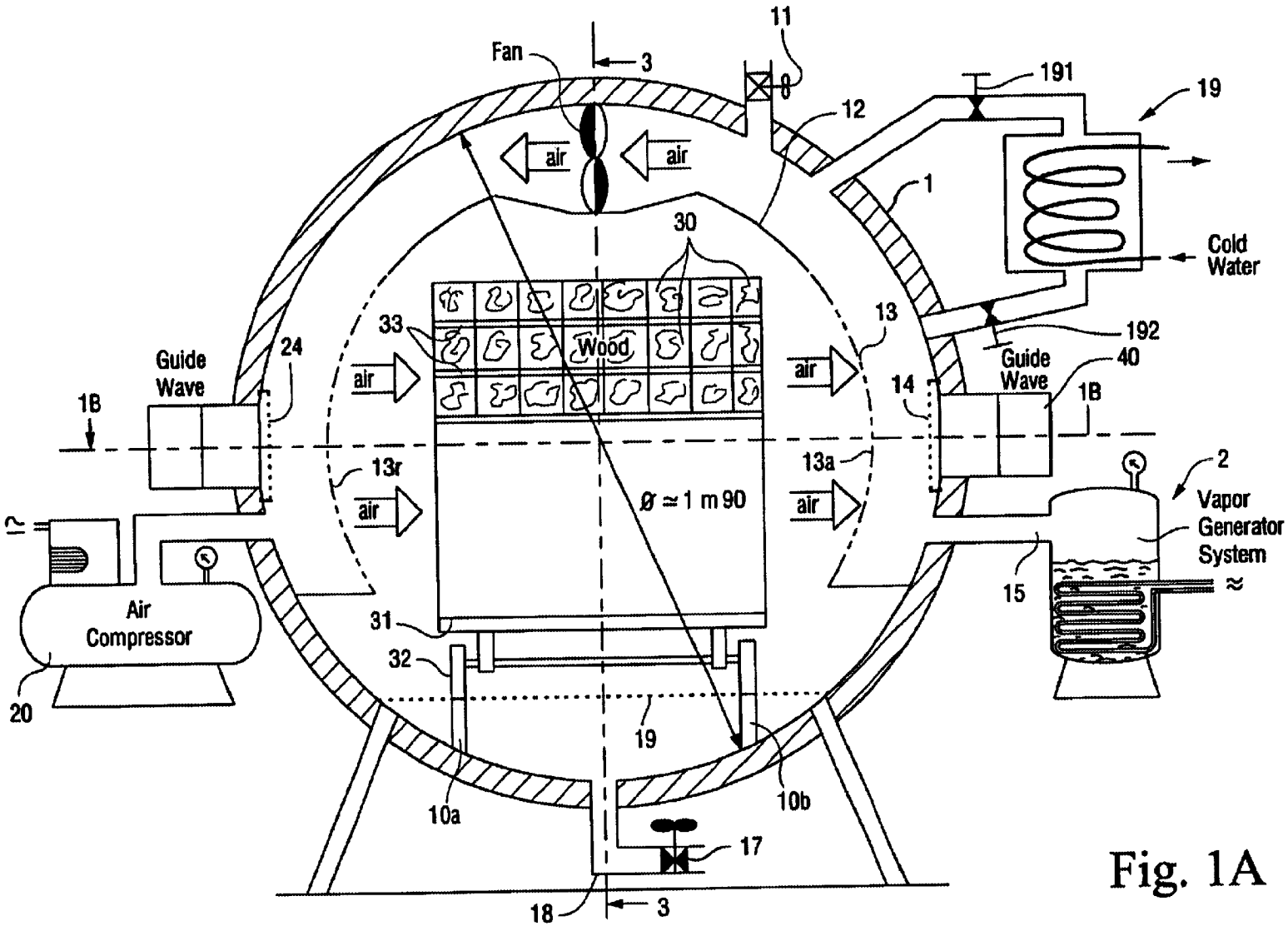
FIG. 1A shows a cross-sectional view of the system of the invention.
Figure 1B:
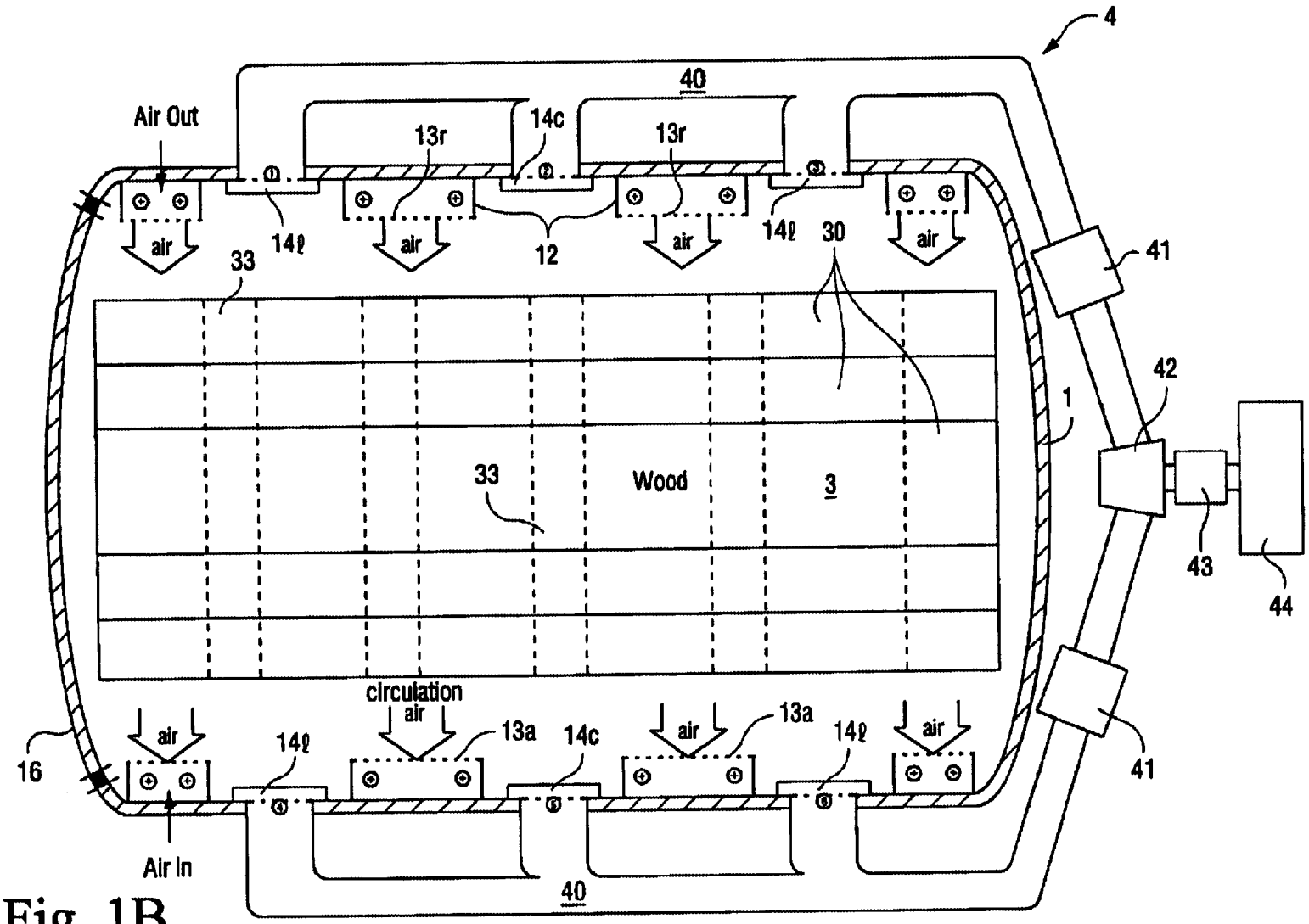
FIG. 1B shows a top view in longitudinal section of the system of the invention.

As shown in FIG. 1A, the system is made up of a chamber 1, preferably cylindrical, in metal material ensuring firstly good thermal insulation and secondly sealing against waves and air pressure. This chamber is open at one end by one or two doors 16, FIG. 1B. Openings 14 are made in the chamber to form windows in a material that is air resistant but which allows the passage of microwave radiation. These pressurized windows 14 are in a material enabling waves to be emitted towards the inside of the chamber and are so-called emitting windows. The waves are brought via a waveguide 40 to a plurality of windows arranged longitudinally, whether at regular intervals or not, along each side of the stack of wood 3 to obtain wave distribution as homogeneous as possible. The waveguide 40 communicates via an impedance adapter 41 and a 3-decibel divider 42 with an insulator 43 and a microwave generator 44. Between each emitting window 14 or between the end emitting windows and each chamber bottom a plurality of pipes 12 are preferably arranged for the forced circulation of air via a fan V. These pipes 12, at a height approximately corresponding to the height of the wood stack, communicate via grids 13 with the inner zone of the chamber containing the wood stack 3 conveyed via conveying means, such as for example a wagon made up of wheels 32 mounted on a support platform 31. The wood stack is preferably made up of pieces 30 in the form of beams or planks or boards of any thickness or width derived from sawmills and arranged side-to-side over their width in longitudinal direction to form one layer. Each layer of wood is separated from the lower layer by battens or sticks 33 arranged perpendicularly but not in abutted manner to form passageways between the side-to-side layers of wood pieces for the circulation of air, waves and water. The air circulation circuit is also made in a material which promotes the reflection of waves towards the inside of the chamber and wood stack. The chamber is connected by piping 15 to a steam generator system 2 and optionally to an air compressor 20. The humidity arrives from the steam regenerator via diffusion grids 13 to enable homogenous distribution within the chamber with no risk of attacking the wood head-on. The air compressor 20 is used to produce compressed air intended to accelerate the circulation of water in the wood, and when the steam generator system 2 is unable to generate steam under sufficient pressure to reach the desired temperature, or to accompany the rise in temperature and accelerate the circulation of wood water. On the other hand, if a steam generating system under sufficient pressure is used to reach the desired temperatures and pressures, the air compressor may be omitted. The wagon wheels rest on rails 10A, 10B integral with the bottom of the chamber 1 and are equipped with an electric arc eliminating device. A grid 19 prevents the propagation of waves towards the liquid exudates or run-off waters collected in the bottom of the chamber. These run-off waters are evacuated via piping 18 controlled by a valve 17. This piping 18 leads to a container, that can be removed or emptied, which collects the liquid exudates resulting from the drying process. In one variant, this opening is permanently open or intermittently open. In another variant, the piping leads to a physico-chemical treatment system to render the exudate compatible with standards in force for waste waters. Finally, the upper part of the chamber comprises a safety valve 11 which is provided to maintain the chamber at the desired pressure, to evacuate pressure if it is too high and finally to place the chamber under atmospheric pressure once the drying process is completed.

Figure 2:
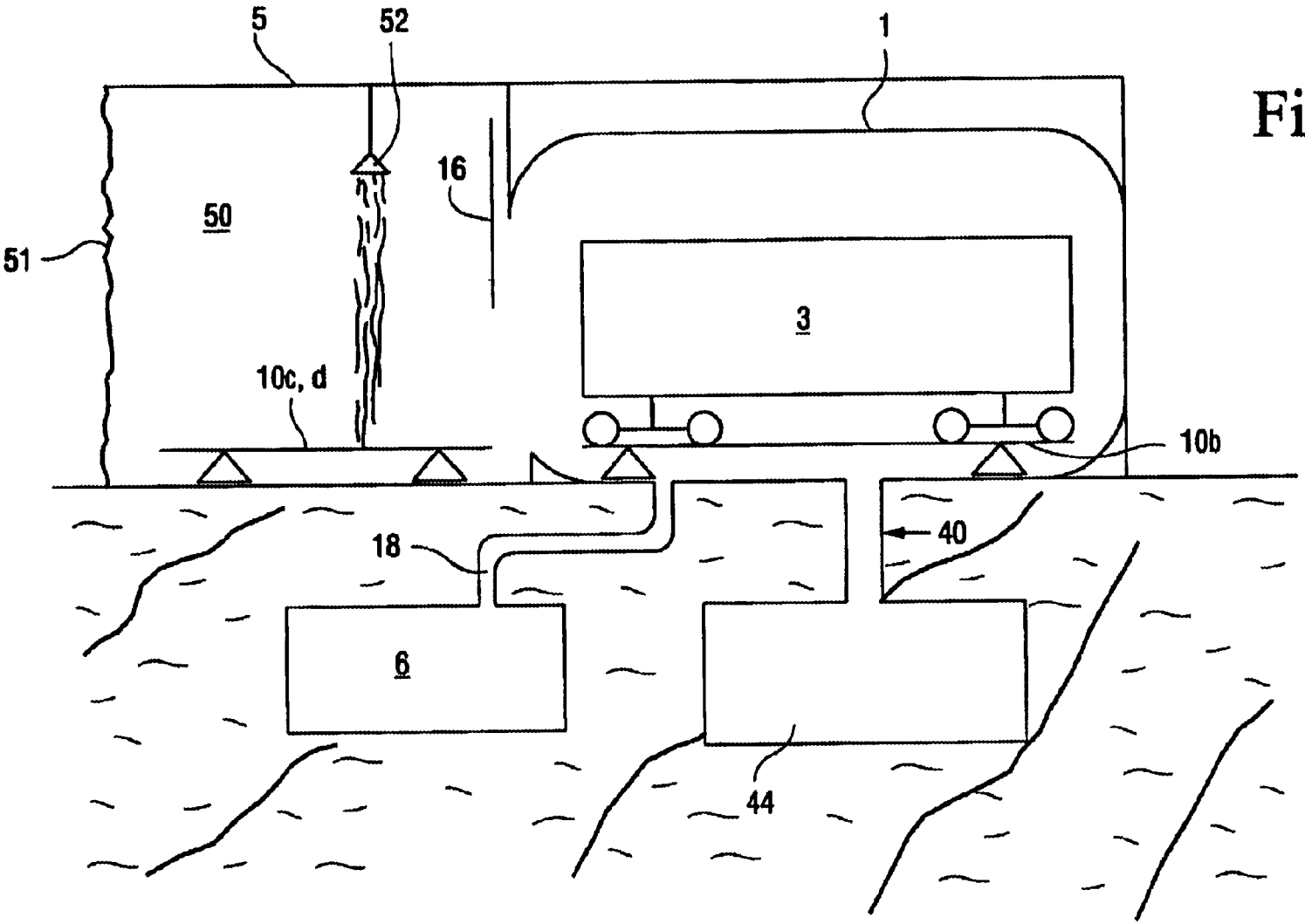
FIG. 2 shows a side view of the system when set up.

In the lay-out diagram shown in FIG. 2, the vessel 1 is enclosed in a chamber 5 connected via the airlock of door 16 automatically controlled at the start and finish by an electronic control system. A pre-loading zone 50 is used to bring the wagons on a pair of rails 10C, 10D which are not electrically connected to rails 10A, 10B of chamber 1. A vaporization system 52 is used to sprinkle water during the microwave application stage to prevent any leakage of radiation towards the outside. A reserve vessel, not shown, that can be removed and emptied, is connected to chamber 1 by piping 18 and is used to collect the liquid exudates resulting from the wood drying. In order to ensure leakage reduction, the microwave generator 44 is buried like the reserve vessel 6 and is connected to the drying chamber 1 via waveguide 40.

The drying process consists of the following operations: placing by transfer means a load of green wood inside the chamber; automatic closing of the chamber door, preferably to prevent any handling errors or shocks; placing the chamber under pressure and diffusion of saturating steam in the chamber until a pressure is reached corresponding to the desired operating temperature under saturating steam. A pressure of 2 bars may be used for a saturating steam temperature of 120° Celsius, and 2.7 bars for a saturating steam temperature of 130° C. It is possible, if needed, to increase to higher saturating steam temperatures, for example 180° Celsius, 200° Celsius or even 220° Celsius by increasing pressure up to 10 bars or 15 bars respectively. The temperature and pressure rises of the process may be made in successive stages, or in ramps, or in cycles allowing optimization of the desired result, complete 0% drying, drying down to a certain moisture content, or production of liquid exudates that can be put to chemical use. This pre-drying phase, under a determined pressure and saturating steam temperature, is maintained for the time that is necessary to move from green (minimum 65% depending upon species) to a so-called "saturation" moisture content of 30%. During this pre-drying step, it is possible to apply the microwaves to accelerate the progression from green moisture content to saturation content. When the required saturation content is reached, the residual moisture contained in the wood is prevented from exiting the wood. At this time, the microwave heating phase takes on all its importance. During the application of the microwave heating phase, the power of the microwaves emitted by the central window 14*c* may be greater than the power emitted by windows 141 positioned either side of the central window; the power is used so as to obtain a temperature differential in the wood which corresponds to a steam pressure differential in the wood. This pressure differential will be used so as to promote the evacuation of water towards the outside of the wood and in the direction of the fibers when the determined operating temperature has been reached. The power of the microwave generators is calculated so as to reach a wood temperature that is greater than that of the saturating steam which may be close to 120° Celsius or higher and produce the desired effect of drying from the inside towards the outside of the wood.

Given the presence of pressure and water-saturated air, the liquid chemical components and the water evacuated from the wood cannot under any circumstances be evaporated and they run down under gravity to be collected below grid 19 by siphon 18. Siphon 18 is set in operation at regular intervals by the control system as soon as the level nears the grid. The chamber comprises a level detector device allowing automatic opening of the valve 17. Each cycle of water evacuation is followed by a cycle of pressure reset in the chamber to saturating steam pressure. With this last phase it is possible to reduce the wood moisture content from 30% to the final desired content, which may be 20%, 10%, 6% or 0%. To achieve complete drying of the wood with a level approaching 0%, the process will comprise at least one phase of determined length during which the temperature will be maintained in a range of approximately 200 to 220° C. and under atmospheric pressure of saturating steam of more than 10 bars. Through the use of a saturating steam atmosphere and higher microwave temperatures, which are nonetheless lower than the temperatures generally used in so-called "cross-linking" processes in an atmosphere that is not steam saturated, it is possible to obtain wood dried to a moisture content approaching 0% and at the same time to achieve a phenomenon of natural polymerization giving the wood humidity-resistant, dimensional stability and easy machining properties. This result is obtained in a shorter time than with known processes and above all with preservation of natural wood color. For the process of the invention does not produce the known wood-darkening phenomenon resulting from the roasting obtained with temperatures between 240 and 300° C.

The drying process may also be used in the system of the invention to produce a liquid exudate incorporating chemical molecules which form a wood species, such as pine, eucalyptus, oak, beech, spruce etc. or a determined mixture of species. This exudate is recovered and optionally re-treated using physico-chemical methods to obtain chemical components which can be used in the cosmetics, pharmaceutical, perfume, agro-foodstuffs, chemical or insecticide industries. Therefore, if solely pine is treated, the exudate obtained will have insecticide properties.

After the time that is necessary to obtain this final moisture content, when the wood is dried, the circulation of saturating steam is halted, the steam generating circuit 2 is closed if necessary. Gates 191, 192 allowing communication with the condenser 19 are opened to enable condensation of the vapor in the chamber and to lower the temperature of the chamber. After a certain time, the microwave generator is also stopped and the pressure reduced until atmospheric pressure is gradually reached.

By placing the ambient medium around the wood under saturation, and through judicious use of microwave power with energy consumption far below usual consumption in the prior art, it is possible to accelerate the inner wood moisture evacuation process and to obtain quicker drying with less energy consumption. Mains water can be used in the sprinkling device.

As shown in FIG. 1A, the device is constituted by a preferably cylindrical enclosure (1) made of a metal material providing, on the one hand, both good thermal insulation and pressure tightness and, on the other hand, wave tightness. This enclosure is open at one end by one door (16, FIG. 1B) or two. Apertures (14) are provided in the enclosure to constitute windows made of an airtight material but letting through radiation from the electromagnetic waves such as for example microwaves. These pressurized windows (14) are made of a material which allows the pressures created in the enclosure to be withstood and the waves to be emitted towards the inside of the enclosure and said emitting windows. These windows (14) are of a size and placed at locations allowing the electromagnetic waves to be sent to the totality of the plant mass introduced into the enclosure and right to its core. The waves are brought by a guide wave (14) to a plurality of windows arranged longitudinally and on each side at intervals whether regular or not along the wood stack (3) to obtain the most homogeneous wave distribution possible. The guide wave (40) communicates through an impedance corrector (41) and a 3-decibel divider (42) with an insulator (43) and the electromagnetic wave generator (44) with a frequency in a frequency range extending between 1 MHz and 16 GHz. Between each emitting window (14) or between the emitting windows of the ends and each enclosure bottom are preferably arranged a plurality of channels (12) circulating air forced by a ventilator V. These channels (12) communicate at a height corresponding approximately to that of the wood stack through grids (13) with the internal zone of the enclosure containing the wood stack (3) transported on a transporting means such as, for example, a truck constituted of wheels (32) mounted on a support plate (31). The stack of wood or ligneous plants is preferably constituted by pieces (30) in the form of branches, planks or boards or beams of unspecified thickness and width, stemming from pruning or sawing and arranged in respect of the planks, boards or beams contiguously over their length or in respect of the branches in a bundle along a longitudinal direction to form a layer. Each layer of wood or plants is spaced out from the lower layer by battens or rods (33) placed perpendicularly in a non-contiguous way so as to provide between the contiguous layers or plant bundles passages for the circulation of air, waves and water. The air circulation circuit is also made of a material facilitating the reflection of waves towards the inside of the enclosure and the wood. The enclosure is connected via a channel (15) with a vapor generator system (2) and possibly, an air compressor (20). The humidity arrives from the vapor generator via scatter grids (13), which allows it to be scattered homogeneously in the enclosure without the danger of causing frontal attacks on the wood. The air compressor (20) is used to produce compressed air intended to accelerate water circulation in the wood and when the vapor generator system (2) cannot generate vapor at sufficient pressure to rise to the desired temperature or to accompany the rise in temperature and accelerate water circulation in the wood. On the other hand, when a vapor generator system is used at sufficient pressure to reach the desired temperatures and pressures, the air compressor may be eliminated. The enclosure comprises means of loading and unloading the masses of plants to be processed and means of recovery of liquors or liquid exudations extracted from the plants. In the example shown, the wheels of the truck run on rails (10A, 10B) integral with the bottom of the tank (1) they are provided with an electric arc elimination device. A grid (19) makes it possible to prevent wave propagation towards the liquid exudations or run-off waters collected in the tank bottom. These run-off waters are drained off through a channel (18) controlled by a sluice (17). This channel (18) emerges in a removable or drainable recovery container for the liquid exudations resulting from the drying process. In a variant, the channel is open permanently or intermittently. Lastly, the upper part of the tank comprises a safety valve (11), which allows the tank to be maintained at the desired pressure, the pressure to be drained off if it is too high and lastly the tank to be put to the atmosphere once the drying process is complete.

In the installation diagram in FIG. 2, the tank (1) is enclosed within an enclosure (5), which communicates via the door-lock (16) controlled automatically at the end and at the outset by an electronic control system. A pre-loading zone (50) allows the trucks to be brought on a pair of rails (10C, 10D), which are not in electrical relation with the rails (10A, 10B) of the enclosure (1). A vaporization device (52) allows water to be projected during the wave use phase to prevent any outward radiation leak. A removable and drainable reserve tank, not shown, is connected to the enclosure (1) by a channel (18) and allows the liquid exudations coming from the drying wood to be collected. To reduce leaks the electromagnetic wave generator (44) is interred like the reserve tank (6) and communicates with the drying enclosure (1) via the guide wave (40)

Figure 3:
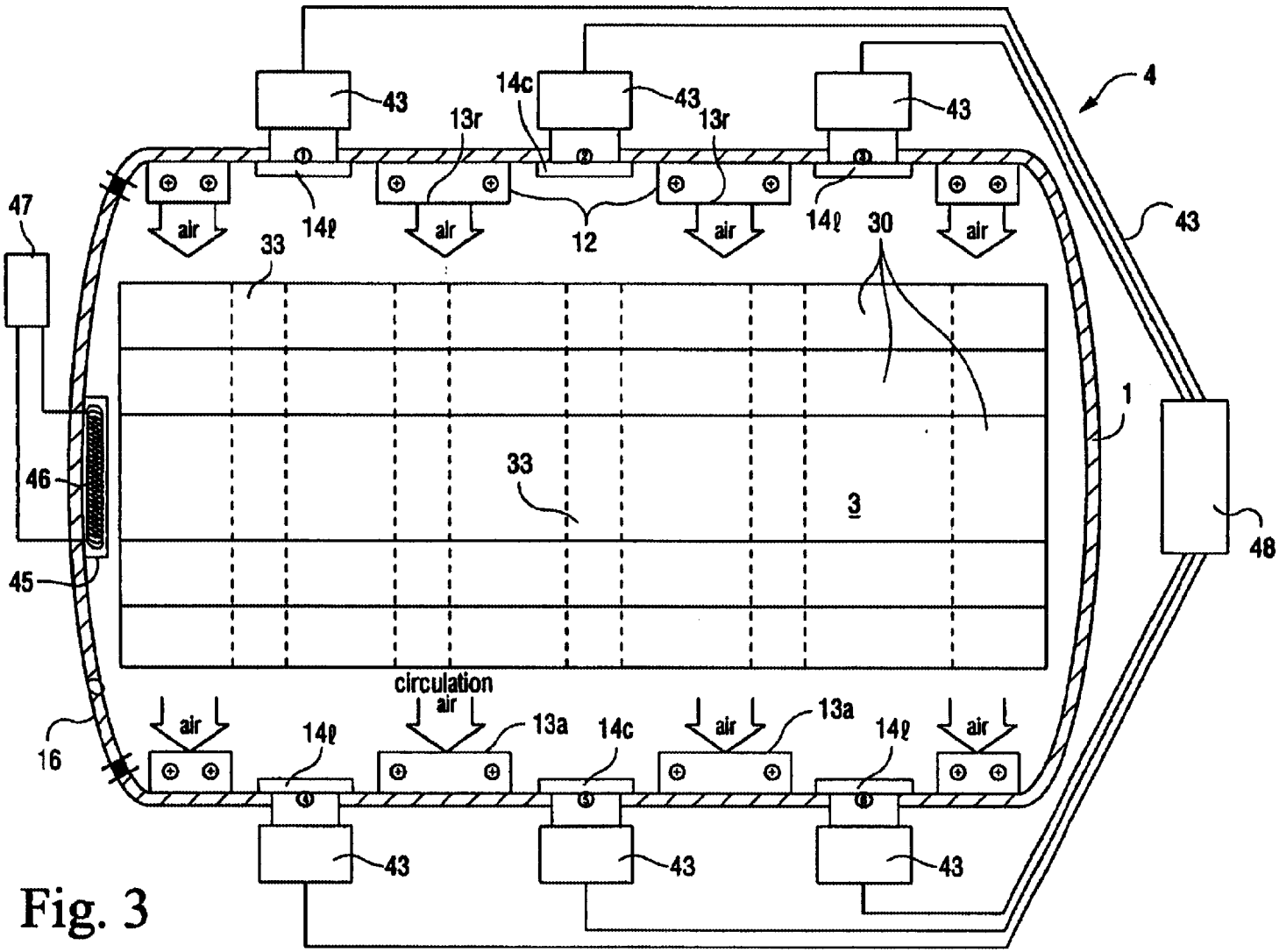
FIG. 3 shows a view from above in longitudinal cross-section of the device according to a second variant of the invention.

FIG. 3 shows a second embodiment variant of the enclosure in which on either side of the enclosure are placed three windows (141), each of the windows being located opposite an electromagnetic wave generator (43) having a power, for example, of about 1000 watts, this power being controlled through a respective link (431), by a control system (48) which allows the power to be adapted, for each wave, as a function of the heating which it is desired to create via the waves within the plant.

The quantity of water required to reach the saturated vapor state depends quite obviously on the temperature at which it is desired to process the plant mass but it may be considered that in the saturated vapor temperature range which varies from 90 to 170° C., the mass required relative to the dry air mass contained in the enclosure at the outset, is about two to four times the air mass. Quite obviously, if too much water is put in, it will remain at the bottom of the receptacle and will not be transformed into the vapor state, unless the temperature and consequently the pressure is further increased. It should be remembered that, in saturated vapor conditions, the temperature of 90° C. corresponds to a total pressure prevailing within the enclosure of 1.5 bars. By "total pressure" is understood the air pressure plus the saturated vapor pressure. The saturated vapor temperature of 100° C. corresponds to a total pressure of 2 bars and 170° C. to a total pressure of 9.6 bars.

Lastly, for energy saving reasons, it is desirable, to optimize the process, to use sufficient electromagnetic wave power to produce within the plant mass a temperature slightly above the temperature prevailing in the enclosure. The purpose of this temperature is to facilitate the extraction of the liquors from the ligneous plant matter. It has also been noted that the higher the pressure, the more the movement of the liquors was facilitated.

2 bars of pressure may be used for a saturated vapor temperature of 100° C., 2.7 bars for a temperature of 130° C., 3 bars for a temperature of 140° C., 3.5 bars for a temperature of 150° C., up to 9.6 bars for a temperature of 170° C. The rises in temperature and pressure may occur in successive stages or gradually or again according to cycles allowing the desired result to be optimized, namely the production of liquors or drying of ligneous matter. The electromagnetic wave power will also be controlled in such a way that a slight temperature and therefore pressure gradient materializes from the center of the stack outwards, the generators located near the end zones of the stack emitting a slightly lower power. The electromagnetic wave frequency is adapted to the size of the mass of plant matter to be processed in the enclosure, so as to allow the waves to penetrate right to the core of the plant mass to be processed and may be selected in the frequency range from 1 MHz, to 16 GHz. The wave frequency may be selected in the electromagnetic wave range between 400 MHz and 2450 MHz or for applications requiring a greater wave penetration. It is possible to use frequencies of the order of 13 or 17 MHz or even between 17 and 400 MHz.

The process also makes it possible, in addition to liquor production, to obtain dried plant matter for other applications, such as the manufacture of posts, dry wood fencing or the use of the other parts of dried plants as additives in for example the manufacture of insulating materials.

Other modifications within reach of the man skilled in the art are also part of the spirit of the invention. Thus, any transport device may be used instead of the rail-mounted truck. Likewise, control and regulation devices will be able to trigger the successive phases of the process in association with more or less sophisticated automation. Likewise, the enclosure comprises a safety valve (11) allowing the enclosure to be opened into the open air, either at the end of the process, or in the event of excess pressure being detected by the control system.

Other modifications able to be conducted by persons skilled in the art also come within the spirit of the invention. Therefore, any transfer system may be used in lieu and stead of the rail-mounted wagons. Also control and regulation devices may be used to set in operation successive phases of the process in conjunction with varying degrees of automation. Also the chamber comprises a safety valve 11 allowing the chamber to be placed in contact with outside air, either at the end of the process or in the event of overpressure detected by the control system.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Wood drying process wherein the wood drying process comprises:

a pressurizing step to place at least one sealed chamber (1) under a determined pressure of saturating steam and maintain this pressure for a determined time interval while ensuring forced circulation of air and saturating steam pressure conditions within the chamber;

a heating step to heat the wood by emitting electromagnetic waves by several means (14) allowing the passage of the electromagnetic waves toward the chamber (1) inside such that to create a temperature differential generating a steam pressure differential in the wood oriented to favor the evacuation of the fluids toward the outside;

a step of interruption of the electromagnetic wave generator (44) and of diminution of the chamber (1) pressure.

2. Process according to claim 1, wherein, during the pressurizing step, the pressure is produced by injecting steam.

3. Process according to claim 1, wherein, during the pressurizing step, the pressure is produced by creating steam.

4. Process according to claim 1, wherein it comprises a step of modification of the temperature and pressure rises following cycles optimizing the process versus the wished result.

5. Process according to claim 1, wherein it comprises an evacuation step to carry away the liquid exudates yielded by the wood.

6. Process according to claim 5, wherein the liquid exudates are permanently evacuated.

7. Process according to claim 5, wherein the liquid exudates are intermittently evacuated.

8. Process according to claim 5, wherein each exudate evacuation cycle is followed by a repressurizing cycle to replace the chamber (1) under a determined pressure of saturating steam.

9. Process according to claim 5, wherein the evacuation comprises a physico-chemical treatment step for the exudates to make them compatible with evacuation toward a waste water circuit.

10. Process according to claim 5, wherein the liquid exudate evacuation step is followed by a step of collection in a container for chemical re-treatment.

11. Process according to claim 1, wherein the pressure-lowering step is completed by a step of de-humidifying the ambient air of the chamber (1) by passage of an air flux issued from the chamber (1) on a moisture absorption device and a step of cooling the air of the chamber (1).

12. Process according to claim 1, wherein electromagnetic wave emitting power applied at the different means are of decreasing magnitude from the center of the wood pieces toward the outside.

13. Process according to claim 1, wherein the pressure of saturating steam lies in a range of 2 bars to 15 bars.

14. Process according to claim 13, wherein the pressure of saturating steam lies in a range of 2 bars to 2.7 bars.

15. Process according to claim 13, wherein the pressure of saturating steam is less than 10 bars to obtain a treated wood moisture content of more than 6%.

16. Process according to claim 13, wherein the pressure of saturating steam lies for at least a determined drying time between 10 and 15 bars and the produced temperature reaches a value in the range of 200 to 220° C. to obtain a dry polymerized wood having a moisture content close to 0%.

17. Process according to claim 1, wherein the power of the electromagnetic waves generator (44) is calculated and controlled so that the inner heat produced in the wood is higher than the temperature of saturating steam.

18. Process according to claim 1, wherein the electromagnetic waves are in a range of frequencies between 1 MHz and 16 GHz.

19. Process according to claim 18, wherein the electromagnetic waves are in a range of frequencies between 13 MHz and 2450 MHz.

20. System enabling the implementation of the process according to claim 1, including a sealed pressure-resistant chamber (1) with means for allowing the passage of electromagnetic waves produced by at least one electromagnetic wave generator (44), said means being arranged crosswise to the stack of wood (3), the chamber communicating with a pressurized air recirculation pathway (12) and a system of homogeneous diffusion of steam in the chamber.

21. System enabling the implementation of the process according to claim 1, including a sealed pressure-resistant chamber (1) with means for allowing the passage of electromagnetic waves produced by at least one electromagnetic wave generator (44), said means being arranged crosswise to the stack of wood (3), the chamber communicating with a pressurized air recirculation pathway (12) and a system of homogeneous creation of steam in the chamber.

22. System according to claim 20, wherein it comprises a steam condensing circuit (19).

23. System according to claim 21, wherein it comprises a steam condensing circuit (19).

24. System according to claim 22, wherein the steam condensing circuit (19) is connected in parallel on the air recirculation circuit (12) and by selectively actuated valves (191, 192).

25. System according to claim 23, wherein the steam condensing circuit (19) is connected in parallel on the air recirculation circuit (12) and by selectively actuated valves (191, 192).

26. System according to claim 20, wherein it comprises a system for the evacuation of the liquid exudates yielded by the wood.

27. System according to claim 21, wherein it comprises a system for the evacuation of the liquid exudates yielded by the wood.

28. System according to claim 26, wherein the system for the evacuation of the liquid exudates is located in the lower part of the chamber (1) constituted by a gravity evacuation outlet (18) to evacuate run-off waters which is controlled by a valve (17).

29. System according to claim 27, wherein the system for the evacuation of the liquid exudates is located in the lower part of the chamber (1) constituted by a gravity evacuation outlet (18) to evacuate run-off waters which is controlled by a valve (17).

30. System according to claim 20, wherein it comprises:

one end that can be closed by an automatic door (16) to ensure sealing against pressure and electromagnetic waves;

transfer system for the loads of green wood to be dried from the outside of the chamber to the inside of the chamber via the end that can be closed.

31. System according to claim 21, wherein it comprises:

one end that can be closed by an automatic door (16) to ensure sealing against pressure and electromagnetic waves;

transfer system for the loads of green wood to be dried from the outside of the chamber to the inside of the chamber via the end that can be closed.

32. System according to claim 20, wherein the unit formed by the chamber and pre-loading zone is encased in a second protective chamber against radiation leakage, this chamber being accessible from the outside via flexible doors.

33. System according to claim 21, wherein the unit formed by the chamber and pre-loading zone is encased in a second protective chamber against radiation leakage, this chamber being accessible from the outside via flexible doors.

34. System according to claim 20, wherein the electromagnetic wave generator is embedded in the ground and communicates with the drying chamber via a waveguide.

35. System according to claim 21, wherein the electromagnetic wave generator is embedded in the ground and communicates with the drying chamber via a waveguide.

36. System according to claim 20, wherein the chamber comprises a safety valve (11).

37. System according to claim 21, wherein the chamber comprises a safety valve (11).

38. System according to claim 36, wherein the valve (17) is opened permanently.

39. System according to claim 36, wherein the valve (17) is opened intermittently.

40. System according to claim 37, wherein the valve (17) is opened permanently.

41. System according to claim 37, wherein the valve (17) is opened intermittently.

42. System according to claim 28, wherein the outlet is connected to a physico-chemical treatment system to make the exudates compatible with evacuation standards for the waste water.

43. System according to claim 29, wherein the outlet is connected to a physico-chemical treatment system to make the exudates compatible with evacuation standards for the waste water.

44. Extraction method for extracting chemical components from wood including the following steps:

a pressurizing step to place at least one sealed chamber (1) under a determined pressure of saturating steam and maintain this pressure for a determined time interval while ensuring forced circulation of air and saturating steam pressure conditions within the chamber;

a heating step to heat the wood by emitting electromagnetic waves by several means (14) allowing the passage of the electromagnetic waves toward the chamber (1) inside, the electromagnetic wave power being adapted to the wood zone to which the power is applied;

an evacuation step to carry away the liquid exudates yielded by the wood.

45. Extraction process according to claim 44, further including treating one single type of species of green wood by applying electromagnetic waves in an atmosphere of saturating steam.

* * * * *